US011957174B2

(12) United States Patent
Gill

(10) Patent No.: US 11,957,174 B2
(45) Date of Patent: Apr. 16, 2024

(54) AEROSOL GENERATING ARTICLE, A METHOD FOR MANUFACTURING AN AEROSOL GENERATING ARTICLE AND AN AEROSOL GENERATING SYSTEM

(71) Applicant: JT International S.A., Geneva (CH)

(72) Inventor: Mark Gill, London (GB)

(73) Assignee: JT International S.A. (CH)

( * ) Notice: Subject to any disclaimer, the term of this patent is extended or adjusted under 35 U.S.C. 154(b) by 834 days.

(21) Appl. No.: 17/045,648

(22) PCT Filed: May 15, 2019

(86) PCT No.: PCT/EP2019/062473

§ 371 (c)(1),
(2) Date: Oct. 6, 2020

(87) PCT Pub. No.: WO2019/224068

PCT Pub. Date: Nov. 28, 2019

(65) Prior Publication Data

US 2021/0153555 A1 May 27, 2021

(30) Foreign Application Priority Data

May 21, 2018 (EP) ..... 18173398

(51) Int. Cl.
*A24F 40/465* (2020.01)
*A24C 5/01* (2020.01)
(Continued)

(52) U.S. Cl.
CPC ..... *A24F 40/465* (2020.01); *A24C 5/01* (2020.01); *A24D 1/20* (2020.01); *A24F 40/70* (2020.01); *A24F 40/20* (2020.01)

(58) Field of Classification Search
CPC ..... A24F 40/465; A24F 40/70; A24F 40/20; A24C 5/01; A24C 5/24; A24D 1/20;
(Continued)

(56) References Cited

U.S. PATENT DOCUMENTS 5,065,776 A * 11/1991 Lawson ..... A24D 1/02 131/194
5,129,409 A * 7/1992 White ..... A24B 15/165 131/84.1
(Continued)

FOREIGN PATENT DOCUMENTS

CN 203353674 U 12/2013
CN 105939624 A 9/2016
(Continued)

OTHER PUBLICATIONS

Search Report dated Apr. 11, 2022 from the Office Action for Chinese Application No. 201880093592.2, dated Apr. 15, 2022, pp. 1-2.
(Continued)

*Primary Examiner* — Edwin A. Leon
(74) *Attorney, Agent, or Firm* — Lerner David LLP

(57) ABSTRACT

An aerosol generating article includes a first body of aerosol forming material, a first tubular member surrounding the first body of aerosol forming material, a second body of aerosol forming material surrounding the first tubular member and a second tubular member surrounding the second body of aerosol forming material. The first tubular member is inductively heatable in the presence of a time varying electromagnetic field.

15 Claims, 7 Drawing Sheets

(51) Int. Cl.
*A24D 1/20* (2020.01)
*A24F 40/20* (2020.01)
*A24F 40/70* (2020.01)

(58) Field of Classification Search
CPC ..... A24D 1/02; A24D 1/002; A24B 15/14; H05B 6/1254
See application file for complete search history.

(56) References Cited

U.S. PATENT DOCUMENTS

| | | | | |
|---|---|---|---|---|
| 5,611,360 | A * | 3/1997 | Tang | A24B 15/165 131/194 |
| 5,954,060 | A * | 9/1999 | Cardarelli | A24D 3/04 131/338 |
| 6,161,552 | A | 12/2000 | Case et al. | |
| 2007/0137667 | A1* | 6/2007 | Zhuang | A24D 1/00 131/367 |
| 2013/0306085 | A1* | 11/2013 | Sanchez | A24D 3/04 493/39 |
| 2014/0020698 | A1 | 1/2014 | Fiebelkorn | |
| 2014/0299142 | A1* | 10/2014 | Dincer | A24D 3/041 131/329 |
| 2015/0157052 | A1 | 6/2015 | Ademe et al. | |
| 2017/0055575 | A1 | 3/2017 | Wilke et al. | |
| 2017/0055581 | A1 | 3/2017 | Wilke et al. | |
| 2017/0055582 | A1 | 3/2017 | Blandino et al. | |
| 2017/0119049 | A1 | 5/2017 | Blandino et al. | |
| 2018/0192700 | A1 | 7/2018 | Fraser et al. | |
| 2018/0338520 | A1 | 11/2018 | Sutton et al. | |
| 2021/0084981 | A1 | 3/2021 | Rogan et al. | |
| 2021/0153555 | A1 | 5/2021 | Gill | |
| 2021/0227877 | A1 | 7/2021 | Brvenik | |

FOREIGN PATENT DOCUMENTS

| | | | |
|---|---|---|---|
| CN | 107373749 | A | 11/2017 |
| CN | 107373761 | A | 11/2017 |
| CN | 107427088 | A | 12/2017 |
| CN | 107708453 | A | 2/2018 |
| CN | 107920600 | A | 4/2018 |
| CN | 107949285 | A | 4/2018 |
| JP | 2014-511675 | A | 5/2014 |
| JP | 5976637 | B2 | 8/2016 |
| JP | 2021523707 | A | 9/2021 |
| JP | 2021524237 | A | 9/2021 |
| JP | 2021524239 | A | 9/2021 |
| KR | 100259781 | B1 | 6/2000 |
| WO | 2011139730 | A1 | 11/2011 |
| WO | 2018002083 | A1 | 1/2018 |
| WO | 2018002084 | A1 | 1/2018 |

OTHER PUBLICATIONS

International Search Report including Written Opinion for Application No. PCT/EP2019/062473 dated Sep. 11, 2019, 12 pages.
International Search Report including Written Opinion for Application No. PCT/EP2018/065155 dated Jan. 23, 2019; 12 pages.

* cited by examiner

AEROSOL GENERATING ARTICLE, A METHOD FOR MANUFACTURING AN AEROSOL GENERATING ARTICLE AND AN AEROSOL GENERATING SYSTEM

CROSS-REFERENCE TO RELATED APPLICATIONS

The present application is a national phase entry under 35 U.S.C. § 371 of International Application No. PCT/EP2019/062473, filed May 15, 2019, published in English, which claims priority to European Application No. 18173398.1 filed May 21, 2018, the disclosures of which are incorporated herein by reference.

TECHNICAL FIELD

The present disclosure relates generally to an aerosol generating article, and more particularly to an aerosol generating article for use with an aerosol generating device for heating the aerosol generating article to generate an aerosol for inhalation by a user. Embodiments of the present disclosure also relate to a method for manufacturing an aerosol generating article and to an aerosol generating system.

TECHNICAL BACKGROUND

Devices which heat, rather than burn, an aerosol forming material to produce an aerosol for inhalation have become popular with consumers in recent years.

Such devices can use one of a number of different approaches to provide heat to the aerosol forming material. One such approach is to provide an aerosol generating device which employs an induction heating system and into which an aerosol generating article, comprising aerosol forming material, can be removably inserted by a user. In such a device, an induction coil is provided with the device and an induction heatable susceptor is provided with the aerosol generating article. Electrical energy is provided to the induction coil when a user activates the device which in turn generates an alternating electromagnetic field. The susceptor couples with the electromagnetic field and generates heat which is transferred, for example by conduction, to the aerosol forming material and an aerosol is generated as the aerosol forming material is heated.

The characteristics of the aerosol generated by the aerosol generating device are dependent upon a number of factors, including the construction of the aerosol generating article used with the aerosol generating device. There is, therefore, a desire to provide an aerosol generating article which enables the characteristics of the aerosol generated during use of the article to be optimised.

SUMMARY OF THE DISCLOSURE

According to a first aspect of the present disclosure, there is provided an aerosol generating article comprising:

- a first body of aerosol forming material;
- a first tubular member surrounding the first body of aerosol forming material;
- a second body of aerosol forming material surrounding the first tubular member;
- a second tubular member surrounding the second body of aerosol forming material;
- wherein the first tubular member is inductively heatable in the presence of a time varying electromagnetic field.

The aerosol generating article is for use with an aerosol generating device for heating the aerosol forming material, without burning the aerosol forming material, to volatise at least one component of the aerosol forming material and thereby generate an aerosol for inhalation by a user of the aerosol generating device.

In general terms, a vapour is a substance in the gas phase at a temperature lower than its critical temperature, which means that the vapour can be condensed to a liquid by increasing its pressure without reducing the temperature, whereas an aerosol is a suspension of fine solid particles or liquid droplets, in air or another gas. It should, however, be noted that the terms 'aerosol' and 'vapour' may be used interchangeably in this specification, particularly with regard to the form of the inhalable medium that is generated for inhalation by a user.

The provision of an inductively heatable first tubular member provides for optimum heat transfer from the inductively heatable first tubular member to both the first and second bodies of aerosol forming material. This in turn provides for optimum heating of the first and second bodies of aerosol forming material and ensures that the characteristics of the aerosol generated during use of the article are optimised.

According to a second aspect of the present disclosure, there is provided a method for manufacturing an aerosol generating article, the method comprising:

- positioning a first tubular member around a first body of aerosol forming material, the first tubular member being inductively heatable in the presence of a time varying electromagnetic field;
- positioning a second body of aerosol forming material around the first tubular member; and
- positioning a second tubular member around the second body of aerosol forming material.

According to a third aspect of the present disclosure, there is provided an aerosol generating system comprising:

- an aerosol generating device comprising an induction coil defining a cavity, the induction coil being configured to generate a time varying electromagnetic field; and
- an aerosol generating article according to the first aspect positioned in the cavity so that a longitudinal axis of the first tubular member is substantially aligned with a longitudinal axis of the cavity.

By positioning the aerosol generating article in the cavity so that the longitudinal axis of the first tubular member is substantially aligned with the longitudinal axis of the cavity, the positional relationship between the first tubular member and the induction coil is optimised thereby providing for optimum coupling of the electromagnetic field with the first tubular member and, thus, optimum heating of the first tubular member during operation of the aerosol generating device.

The first tubular member may include a closed electrical circuit formed by an inductively heatable susceptor material. The closed electrical circuit may surround the first body of aerosol forming material. This ensures that optimal heating of the aerosol forming material is achieved. The closed electrical circuit may have substantially the same electrical resistance at all points around the electrical circuit. This provides for uniform heating of the aerosol forming material. Further, by avoiding localised points around the electrical circuit with higher electrical resistance, the risk of breakage of the first tubular member, for example at a joint between longitudinally extending free edges of the first tubular member, is reduced.

The first tubular member may comprise a single continuous piece of material. The structural integrity of the first tubular member is thereby maximised.

The first tubular member may comprise a wrapper formed of an inductively heatable susceptor material. For example, the first tubular member may comprise a metal wrapper. With the application of a time varying electromagnetic field in its vicinity, heat is generated in the inductively heatable susceptor material due to eddy currents and magnetic hysteresis losses resulting in a conversion of energy from electromagnetic to heat. By forming the first tubular member of an inductively heatable susceptor material, eddy currents are advantageously generated throughout the first tubular member, ensuring that the first tubular member is uniformly heated and thereby ensuring uniform heating of the aerosol forming material.

The inductively heatable susceptor material may comprise one or more, but not limited, of aluminium, iron, nickel, stainless steel and alloys thereof, e.g. Nickel Chromium or Nickel Copper.

The wrapper may include free edges and the aerosol generating article may include holding means for holding together the free edges of the wrapper. The holding means ensure that the free edges of the wrapper are securely held together to maintain electrical contact between them.

The holding means may comprise a joint which connects the free edges of the wrapper to each other. The joint may have an electrical resistance which is higher than an electrical resistance of the wrapper. The higher electrical resistance may advantageously provide a point of weakness which can be exploited to prevent re-use of the aerosol generating article in an aerosol generating device, thus avoiding the generation of undesirable flavour compounds from previously heated aerosol forming material within the aerosol generating article. For example, the electrical resistance of the joint may be selected to cause failure of the joint during attempted re-use of the aerosol generating article in an aerosol generating device as the article is heated to its target temperature. The joint may, for example, be an adhesive joint which comprises an electrically conductive adhesive adhering free edges, possibly overlapping free edges, of the wrapper to each other. The joint may alternatively be a welded joint or may be a soldered joint.

Alternatively or additionally, the holding means may be provided by the second body of aerosol forming material and the second tubular member. In this arrangement, it will be understood that the second body of aerosol forming material and the second tubular member apply a compressive force to the wrapper thereby ensuring that the free edges of the wrapper are held together.

The free edges of the wrapper may overlap to provide a multilayer wrapper having a plurality of overlapping circumferential layers, for example two layers. The provision of a plurality of overlapping circumferential layers may provide for more effective heating of the aerosol forming material.

The first tubular member may further include a wrapper comprising a material which is substantially non-electrically conductive and non-magnetically permeable.

The first tubular member may comprise a first wrapper formed of an inductively heatable susceptor material and a second wrapper comprising a material which is substantially non-electrically conductive and non-magnetically permeable. The first wrapper may comprise a metal wrapper and the second wrapper may comprise a paper wrapper. The first wrapper may be arranged radially inwardly of the second wrapper so that the first wrapper contacts the first body of aerosol forming material. The first wrapper may alternatively be arranged radially outwardly of the second wrapper so that the first wrapper contacts the second body of aerosol forming material. The use of both a first wrapper, such as a metal wrapper, and a second wrapper, such as a paper wrapper, in combination may simplify the manufacture of the first tubular member. For example, the first tubular member could be manufactured by assembling together the first and second wrappers and thereafter positioning the assembled first and second wrappers, constituting the first tubular member, around the first body of aerosol forming material. In additional, the use of both a first wrapper, such as a metal wrapper, and a second wrapper, such as a paper wrapper, in combination may allow the heating of the first and second bodies of aerosol forming material to be more carefully controlled because the radially inner and outer surfaces of the first tubular member comprise different materials.

The first tubular member may comprise a first wrapper formed of an inductively heatable susceptor material and second and third wrappers comprising a material which is substantially non-electrically conductive and non-magnetically permeable. The first wrapper may comprise a metal wrapper and each of the second and third wrappers may comprise a paper wrapper. The first wrapper may be positioned between the second and third wrappers. With this arrangement, it will be understood that the first, preferably metal, wrapper does not directly contact either of the first or second bodies of aerosol forming material.

The first tubular member may comprise a wrapper formed of a material that is substantially non-electrically conductive and non-magnetically permeable, for example a paper wrapper, and at least one track of electrically conductive material extending circumferentially around the wrapper to form a closed circuit. The first tubular member may include a plurality of said electrically conductive tracks at axially spaced positions along the wrapper, with each track forming a closed circuit. The electrically conductive tracks are inductively heated during use of the aerosol generating article and heat is transferred from the electrically conductive tracks to the aerosol forming material.

The or each electrically conductive track may be mounted on an inner surface of the wrapper or on an outer surface of the wrapper. In embodiments which employ a plurality of axially spaced electrically conductive tracks, the electrically conductive tracks may be mounted on both the inner and outer surfaces of the wrapper. For example axially adjacent electrically conductive tracks may be mounted in an alternating and repeating manner on the inner and outer surfaces respectively of the wrapper.

The second tubular member may comprise a material which is substantially non-electrically conductive and non-magnetically permeable. The second tubular member may comprise a wrapper and may, for example, comprise a paper wrapper. The wrapper may have longitudinally extending free edges, for example overlapping free edges, which are secured together using an adhesive which may also be substantially non-electrically conductive and non-magnetically permeable.

The first tubular member may define an inner cavity in which the first body of aerosol forming material may be positioned and the first and second tubular members may define therebetween an annular cavity which may be separate from the inner cavity and in which the second body of aerosol forming material may be positioned. With this arrangement, the first and second bodies of aerosol forming material are isolated from each other in the inner and annular cavities.

The aerosol generating article may be elongate and the axial ends of the first body of aerosol forming material, the second body of aerosol forming material and the first tubular member may be axially aligned. This arrangement provides for optimal heating of the aerosol forming material by the inductively heatable first tubular member as the first tubular member extends over entire length of the aerosol forming material.

The first and second bodies of aerosol forming material may each have respective first and second cross-sectional areas and the first and second cross-sectional areas may be substantially the same. With this arrangement, heat transfer from the first tubular member to both the first and second bodies of aerosol forming material is maximised and this provides for optimal heating of the aerosol forming material by the inductively heatable first tubular member. In typical embodiments in which the cross-sectional areas are substantially the same, the cross-sectional area of the first body of aerosol forming material may between 70% and 130% of the cross-sectional area of the second body of aerosol forming material, possibly between 90% and 110% and more typically between 95% and 105%.

The first and second bodies of aerosol forming material may each have respective first and second volumes and the first and second volumes may be substantially the same. With this arrangement, heat transfer from the first tubular member to both the first and second bodies of aerosol forming material is maximised and this provides for optimal heating of the aerosol forming material by the inductively heatable first tubular member. In typical embodiments in which the volumes are substantially the same, the volume of the first body of aerosol forming material may between 70% and 130% of the volume of the second body of aerosol forming material, possibly between 90% and 110% and more typically between 95% and 105%.

The first and second tubular members may be substantially concentric. The construction of the aerosol generating article is thereby simplified.

As noted above, the aerosol generating article may be elongate and may be substantially cylindrical. The cylindrical shape of the aerosol generating article with its circular cross-section may advantageously facilitate insertion of the aerosol generating article into a heating compartment of an induction heating assembly of an aerosol generating device in which the induction heating assembly includes a helical induction coil having a circular cross-section.

The first body of aerosol forming material may substantially fill the interior of the first tubular member and may substantially fill the aforesaid inner cavity of the first tubular member. The second body of aerosol forming material may substantially fill the space between the first and second tubular members and may substantially fill the aforesaid annular cavity. With this arrangement, void space in the interior of the first tubular member and/or in the region between the first and second tubular members is substantially eliminated thereby maximising the amount of aerosol that is generated during use of the aerosol generating article.

The aerosol generating article may further comprise an air-permeable plug at an axial end thereof. The air-permeable plug could comprise cellulose acetate fibres. The air-permeable plug may advantageously retain the first body of aerosol forming material inside the first tubular member and the second body of aerosol forming material between the first and second tubular members. The aerosol generating article may include a first one of said air-permeable plugs at a first axial end thereof and a second one of said air-permeable plugs at a second axial end thereof. The provision of first and second air-permeable plugs may provide improved retention of the first and second bodies of aerosol forming material. In addition, because the first tubular member acts as an inductively heatable susceptor, the first and second bodies of aerosol forming material are heated during use of the article without it being necessary to penetrate the first or second air-permeable plugs with a heating element of an aerosol generating device.

A body of air-permeable material may be positioned between the or each air-permeable plug and the first and second bodies of aerosol forming material. The body of air-permeable material may comprise a vapour cooling medium. The vapour cooling medium may help to reduce the temperature of the vapour produced by heating the first and second bodies of aerosol forming material to produce an aerosol with optimum characteristics for inhalation by a user.

The first and second bodies of aerosol forming material may comprise a single body of homogenous aerosol forming material. For example, the aerosol forming material may comprise granules or pellets. In some embodiments, the first tubular member may comprise a pipe or tube and may have a rigid structure. The aerosol generating article may include an air-permeable plug at one axial end thereof and may include an air-permeable structure, such as a mesh, at the opposite axial end which may be formed integrally as a single component with the second tubular member. The air-permeable plug and the air-permeable structure advantageously retain the single body of homogenous aerosol forming material in position.

The first and second bodies of aerosol forming material may have characteristics which differ in at least one or more respects, including aerosolisation temperature, humectant content, flavour and density. For example, the first body of aerosol forming material may have a higher humectant content than the second body of aerosol forming material. With this arrangement, staining of the second tubular member, which may be a paper wrapper, due to the lower content of humectant in the second body of aerosol forming material is minimised or avoided entirely thereby improving the appearance and user-appeal of the aerosol generating article. At the same time, the higher content of humectant in the first body of aerosol forming material ensures that the overall content of humectant is sufficient to provide the required level of aerosol generation during use of the aerosol generating article. By providing a higher content of humectant in the first body of aerosol forming material than in the second body of aerosol forming material, it is possible in some embodiments that the cross-sectional area and/or the volume of the first body of aerosol forming material may be lower than the cross-sectional area and/or the volume of the second body of aerosol forming material.

The aerosol forming material of the first and second bodies may be any type of solid or semi-solid material. In addition to granules and pellets as mentioned above, example types of aerosol forming solids include powder, shreds, strands, particles, gel, strips, loose leaves, cut filler, porous material, foam material or sheets. The aerosol forming material may comprise plant derived material and in particular, the aerosol forming material may comprise tobacco.

The aerosol forming material of the first and second bodies may comprise an aerosol-former. Examples of aerosol-formers include polyhydric alcohols and mixtures thereof such as glycerine or propylene glycol. Typically, the aerosol forming material may comprise an aerosol-former content of between approximately 5% and approximately 50% on a dry weight basis. In some embodiments, the aerosol forming material may comprise an aerosol-former content of approximately 15% on a dry weight basis.

Upon heating, the aerosol forming material may release volatile compounds. The volatile compounds may include nicotine or flavour compounds such as tobacco flavouring.

In the method according to the second aspect, the step of positioning the first tubular member around the first body of aerosol forming material may be performed before the steps of positioning the second body of aerosol forming material around the first tubular member and positioning the second tubular member around the second body of aerosol forming material. Typically, the step of positioning the second body of aerosol forming material around the first tubular member is performed before the step of positioning the second tubular member around the second body of aerosol forming material. Performing the steps in this order may facilitate the manufacture of the aerosol generating article.

The first tubular member may comprise a sheet of material which may include longitudinally extending free edges.

The step of positioning the first tubular member around the first body of aerosol forming material may comprise wrapping the sheet of material around the first body of aerosol forming material. The step of positioning the first tubular member around the first body of aerosol forming material may comprise wrapping the sheet of material around the first body of aerosol forming material multiple times to provide a multilayer wrapper having a plurality of overlapping circumferential layers, for example two layers.

In embodiments in which the first tubular member comprises a sheet of inductively heatable susceptor material having longitudinally extending free edges, the step of positioning the first tubular member around the first body of aerosol forming material may comprise wrapping the sheet of material around the first body of aerosol forming material to form a closed electrical circuit between the longitudinally extending free edges of the sheet. For example, the wrapping step may comprise adhering the free edges of the sheet to each other using an electrically conductive adhesive, welding the free edges of the sheet to each other, soldering the free edges of the sheet to each other, applying a compressive force to the sheet to maintain contact between the free edges or overlapping the free edges of the sheet, or deforming, e.g. punching, crimping or seaming, the overlapping free edges to secure them together.

In embodiments in which the aerosol generating article includes an air-permeable plug at one or both axial ends either with or without a body of air-permeable material (e.g. a vapour cooling medium) positioned between the or each air-permeable plug and the first and second bodies of aerosol forming material, an outer wrapper, for example a paper wrapper, may circumscribe the article components, i.e., the first and second bodies of aerosol forming material, the first and second tubular members, the or each air-permeable plug and the optional body or bodies of air-permeable material. The outer wrapper may circumscribe only the interface of any two of the following components; an aerosol generating rod (i.e., the first and second bodies of aerosol forming material and the first and second tubular members), an air-permeable plug and the optional body of air-permeable material, to secure the positional relationship of these components. The method may comprise positioning the or each air-permeable plug in coaxial alignment with the first and second bodies of aerosol forming material and the first and second tubular members after the step of positioning the second tubular member around the second body of aerosol forming material so that the or each air-permeable plug is axially aligned with said components. The method may further comprise positioning the outer wrapper around the article components so that it circumscribes the article components.

The above steps can be conducted to produce a continuous rod from which multiple aerosol generating articles can be produced by cutting the rod into predetermined lengths, each of which corresponds to an individual aerosol generating article. This type of method is suitable for the mass production of aerosol generating articles.

The method may comprise producing a continuous rod comprising the first and second bodies of aerosol forming material and the first and second tubular members, and then cutting the rod at predetermined points along its length to provide a plurality of aerosol generating articles.

In some embodiments, the method may comprise: producing a continuous rod comprising a plurality of article segments each comprising first and second bodies of aerosol forming material and associated first and second tubular members, an air-permeable plug arranged between each article segment and optionally a body of air-permeable material (e.g. a vapour cooling medium) positioned between each air-permeable plug and the first and second bodies of aerosol forming material; positioning an outer wrapper around the plurality of article segments, air-permeable plugs and bodies of air-permeable material if present; and cutting the rod at predetermined points along its length. This method produces a plurality of aerosol generating articles, each comprising an air-permeable plug at one or both axial ends and in which the components of each aerosol generating article are circumscribed by a length of the outer wrapper. The method may comprise cutting the continuous rod in the middle of each air-permeable plug to produce a plurality of aerosol generating articles which have an air-permeable plug at each axial end thereof.

The second tubular member may comprise a sheet of material and the step of positioning the second tubular member around the second body of aerosol forming material may comprise wrapping the sheet of material around the second body of aerosol forming material. Preferably, the second tubular member is formed of a material which is substantially impermeable to air and/or vapour. This assists in constraining the flow of air and vapour to a desired air/vapour flow path. Preferably, the second tubular member is formed of a material which is liquid absorbent to some extent. This can assist with preventing any build up of liquid (e.g. condensation) formed on the inside of an aerosol generating device for use with the aerosol generating article. Paper is good example of such a material although other woven or non-woven fabrics may also be suitable as would be apparent to a person skilled in the art.

In the aerosol generating system according to the third aspect, the aerosol generating device may include an air inlet arranged to provide air to the cavity, preferably at a lower end of the cavity, and may include an air outlet in communication with the cavity. The cavity may act as a heating compartment of the aerosol generating device.

In a system which employs an aerosol generating article with an air-permeable plug positioned at the lower end of the cavity when the aerosol generating article is located in the cavity, the air-permeable plug can direct the incoming air into both the first and second bodies of aerosol forming material and prevent the first and second bodies of aerosol forming material from dropping in the cavity.

In some embodiments, the aerosol generating device may include two air inlets arranged to provide air to the cavity. In particular, the aerosol generating device may comprise a first air inlet arranged to direct air to the first body of aerosol forming material and a second air inlet arranged to direct air to the second body of aerosol forming material. The aerosol generating device is particularly, but not exclusively, suitable for use with an aerosol generating article which does not have an air-permeable plug positioned at the lower end of the cavity when the aerosol generating article is located in the cavity.

DETAILED DESCRIPTION OF EMBODIMENTS

Embodiments of the present disclosure will now be described by way of example only and with reference to the accompanying drawings.

Figure 1:
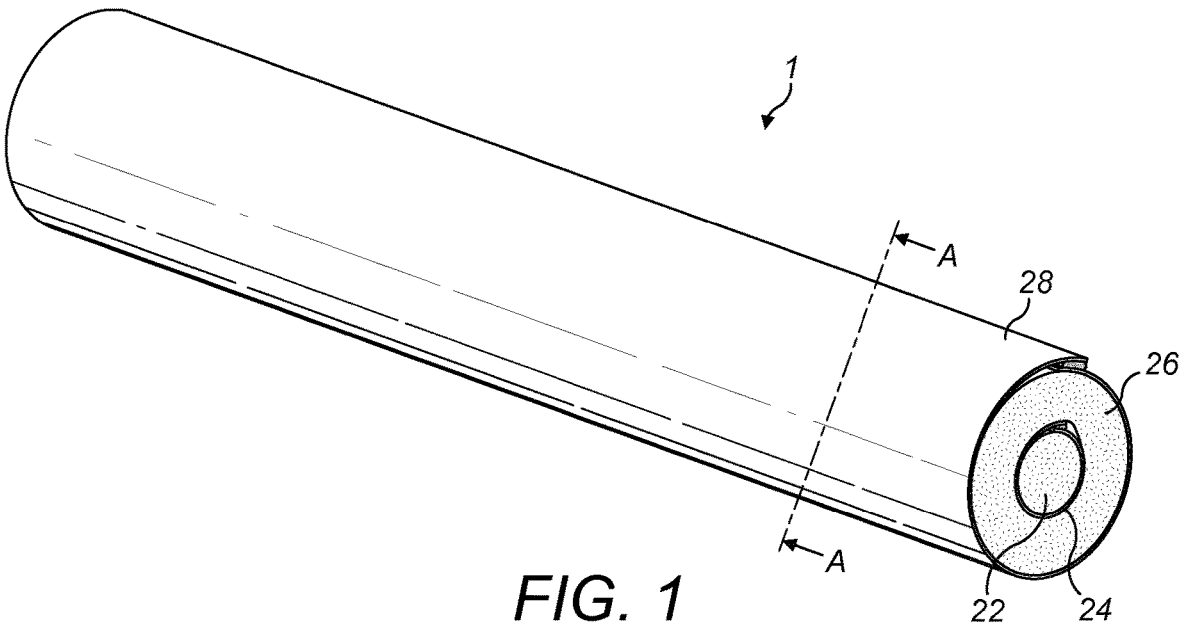
FIG. 1 is a diagrammatic perspective view of a first example of an aerosol generating article.
Figure 2:
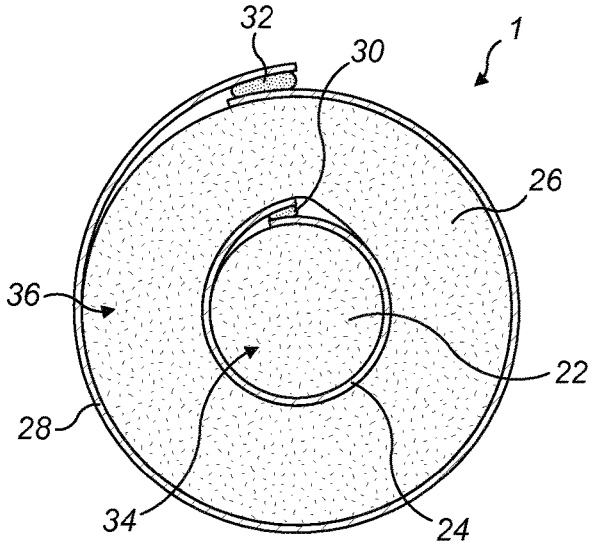
FIG. 2 is a diagrammatic cross-sectional view along the line A-A shown in FIG. 1.

Referring initially to FIGS. 1 and 2, there is shown a first example of an aerosol generating article 1 for use with an aerosol generating device, examples of which will be described later in this specification. The aerosol generating article 1 is elongate and substantially cylindrical. The circular cross-section facilitates handling of the article 1 by a user and insertion of the article 1 into a heating compartment of an aerosol generating device.

The article 1 comprises a first body of aerosol forming material 22, a first tubular member 24 surrounding the first body of aerosol forming material 22, a second body of aerosol forming material 26 surrounding the first tubular member 24 and a second tubular member 28 surrounding the second body of aerosol forming material 26.

The first tubular member 24 is inductively heatable in the presence of a time varying electromagnetic field. In the illustrated first example, the first tubular member 24 comprises a metal wrapper formed of an inductively heatable susceptor material. The metal wrapper comprises a single sheet of material, for example a metal foil, having longitudinally extending free edges which are arranged to overlap each other and which are secured together by an electrically conductive adhesive 30 which forms a joint between the free edges. The electrically conductive adhesive 30 typically comprises one or more adhesive components interspersed with one or more electrically conductive components. The metal wrapper and the electrically conductive adhesive 30 together form a closed electrical circuit which surrounds the first body of aerosol forming material 22.

When a time varying electromagnetic field is applied in the vicinity of the metal wrapper during use of the article 1 in an aerosol generating device, heat is generated in the metal wrapper due to eddy currents and magnetic hysteresis losses and the heat is transferred from the metal wrapper to the adjacent first and second bodies of aerosol forming material 22, 26 to heat the aerosol forming material without burning it and to thereby generate an aerosol for inhalation by a user. The metal wrapper constituting the first tubular member 22 is in contact over substantially its entire inner and outer surfaces with the aerosol forming material of the first and second bodies 22, 26 respectively, thus enabling heat to be transferred directly, and therefore efficiently, from the metal wrapper to the aerosol forming material.

The second tubular member 28 is concentric with the first tubular member 24 and comprises a paper wrapper. Although a paper wrapper may be preferred, the second tubular member 28 can comprise any material which is substantially non-electrically conductive and non-magnetically permeable so that the second tubular member 28 is not inductively heated in the presence of a time varying electromagnetic field during use of the article 1 in an aerosol generating device. The paper wrapper constituting the second tubular member 28 also comprises a single sheet of material having longitudinally extending free edges which are arranged to overlap each other and which are secured together by an adhesive 32 which is substantially non-electrically conductive and non-magnetically permeable so that it is not inductively heated during use of the article 1 in an aerosol generating device.

The first tubular member 24 defines an inner cavity 34 in which the first body of aerosol forming material 22 is positioned and the first and second tubular members 24, 28 define therebetween an annular cavity 36 which is separate from the inner cavity 34 and in which the second body of aerosol forming material 26 is positioned. The first and second bodies of aerosol forming material 22, 26 and the first and second tubular members 24, 28 all have the same axial length and are arranged so that axial ends of the first and second bodies of aerosol forming material 22, 26 are axially aligned with the metal wrapper constituting the first tubular member 24 and with the paper wrapper constituting the second tubular member 28. With this arrangement, the first and second bodies of aerosol forming material 22, 26 are isolated from each other in the respective inner and annular cavities 34, 36. The first body of aerosol forming material 22 substantially fills the inner cavity 34 and the second body of aerosol forming material 26 substantially fills the annular cavity 36.

The aerosol forming material of the first and second bodies 22, 26 is typically a solid or semi-solid material. Examples of suitable aerosol forming solids include powder, shreds, strands, porous material, foam material and sheets. The aerosol forming material typically comprises plant derived material and, in particular, comprises tobacco.

The aerosol forming material of the first and second bodies 22, 26 comprises an aerosol-former such as glycerine or propylene glycol. Typically, the aerosol forming material may comprise an aerosol-former content of between approximately 5% and approximately 50% on a dry weight basis. Upon heating due to heat transfer from the metal wrapper constituting the first tubular member 24, the aerosol forming material of both the first and second bodies 22, 26 releases volatile compounds possibly including nicotine or flavour compounds such as tobacco flavouring.

In the article 1 of FIGS. 1 and 2, although the first and second bodies 22, 26 of aerosol forming material are isolated from each other in the respective inner and annular cavities 34, 36, the first and second bodies 22, 26 comprise the same type of aerosol forming material having the same characteristics, including for example aerosolisation temperature, humectant content, flavour and density.

The article 1 is typically manufactured by wrapping the metal wrapper constituting the first tubular member 24 around the first body of aerosol forming material 22 so that the longitudinally extending free edges of the metal wrapper overlap each other. As explained above, an electrically conductive adhesive 30 is applied to one or both of the overlapping edges of the metal wrapper to secure them together and to thereby form a closed electrical circuit. The second body of aerosol forming material 26 is then positioned around the metal wrapper before the paper wrapper constituting the second tubular member 28 is wrapped around the second body of aerosol forming material 26 so that the longitudinally extending free edges of the paper wrapper overlap each other. As also explained above, a non-electrically conductive and non-magnetically permeable adhesive 32 is applied to one or both of the overlapping edges of the paper wrapper to secure them together.

Figure 3:
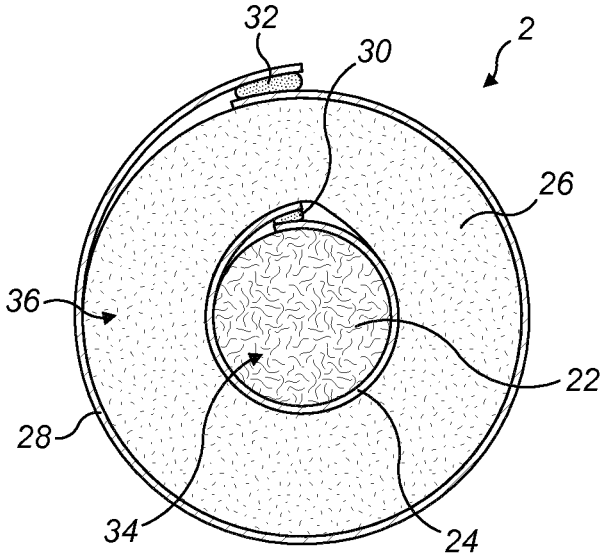
FIG. 3 is a diagrammatic cross-sectional view of a second example of an aerosol generating article similar to the first example shown in FIGS. 1 and 2.

Referring now to FIG. 3, there is shown a diagrammatic cross-sectional view of a second example of an aerosol generating article 2 which is similar to the aerosol generating article 1 illustrated in FIGS. 1 and 2 and in which corresponding elements are designated using the same reference numerals.

The aerosol generating article 2 is identical to the aerosol generating article 1 illustrated in FIGS. 1 and 2 in all respects except that the first and second bodies of aerosol forming material 22, 26 have characteristics which differ in at least one or more respects, including aerosolisation temperature, humectant content, flavour and density.

In one embodiment, the first body of aerosol forming material 22 in the inner cavity 34 has a higher humectant content than the second body of aerosol forming material 26 in the annular cavity 36. As explained earlier in this specification, a lower humectant content in the second body of aerosol forming material 26 may advantageously reduce staining of the paper wrapper and thereby improve the appearance and user appeal of the article 2. With this arrangement, it may also be possible to provide a first body of aerosol forming material 22 which has a smaller cross-sectional area and/or a smaller volume than would otherwise be needed due to the higher humectant content, whilst at the same time maintaining the required level of aerosol generation during use of the article 2.

Figure 4:
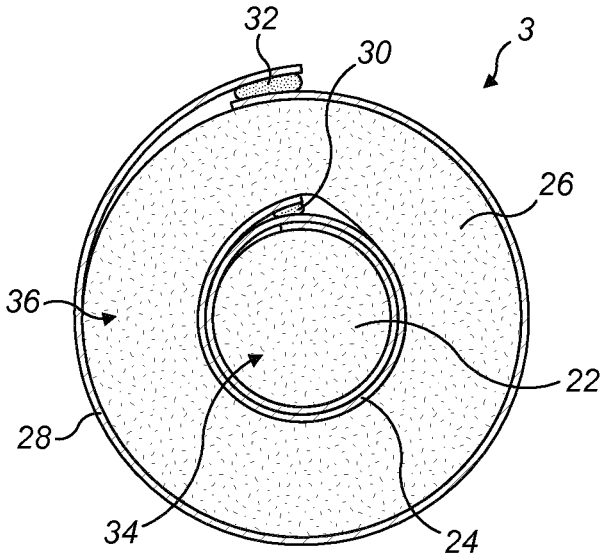
FIG. 4 is a diagrammatic cross-sectional view of a third example of an aerosol generating article similar to the first example shown in FIGS. 1 and 2.

Referring now to FIG. 4, there is shown a diagrammatic cross-sectional view of a third example of an aerosol generating article 3 which is similar to the aerosol generating article 1 illustrated in FIGS. 1 and 2 and in which corresponding elements are designated using the same reference numerals.

The aerosol generating article 3 is identical to the aerosol generating article 1 illustrated in FIGS. 1 and 2 in all respects except that the degree of overlap of the longitudinally extending free edges of the metal wrapper constituting the first tubular member 24 is substantially greater, to the extent that the free edges overlap each other to provide a multilayer metal wrapper which in the illustrated embodiment has two overlapping circumferential layers at all points around the circumference of the first tubular member 24. It will be appreciated that the provision of a plurality of layers provides for increased heat generation in the metal wrapper during use of the aerosol generating article 3.

Figure 5:
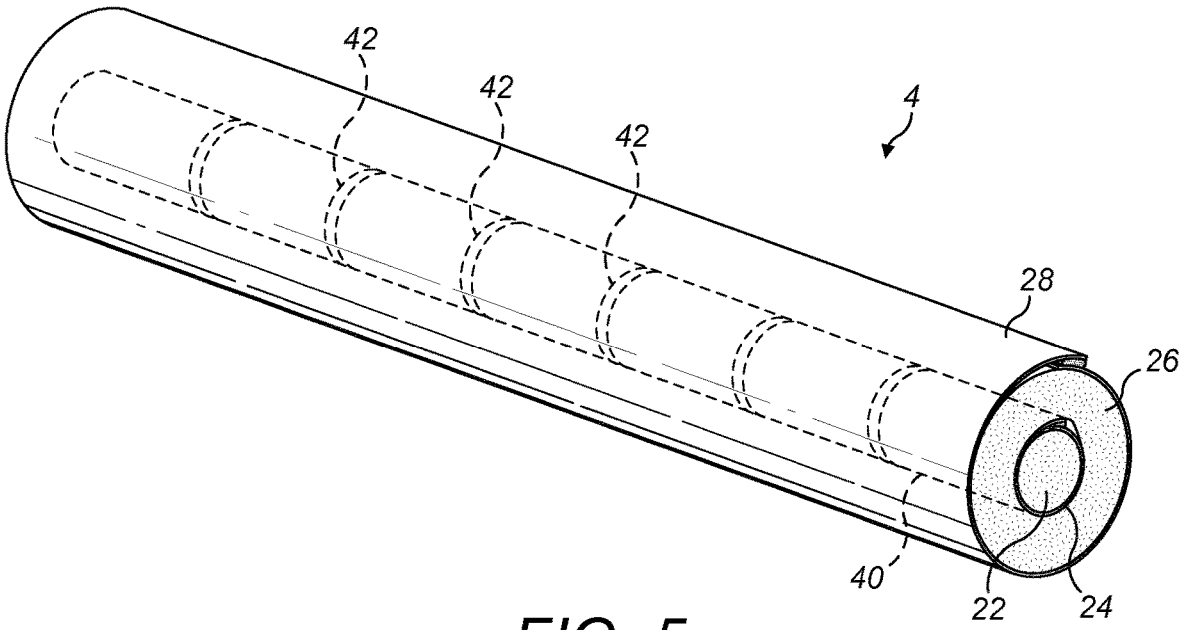
FIG. 5 is a diagrammatic perspective view of a fourth example of an aerosol generating article.

Referring now to FIG. 5, there is shown a diagrammatic perspective view of a fourth example of an aerosol generating article 4 which is similar to the aerosol generating article 1 illustrated in FIGS. 1 and 2 and in which corresponding elements are designated using the same reference numerals.

The aerosol generating article 4 is identical to the aerosol generating article 1 illustrated in FIGS. 1 and 2 in all respects except for the construction of the first tubular member 24. In the article 4, the first tubular member 24 comprises a material that is substantially non-electrically conductive and non-magnetically permeable, for example a paper wrapper 40. A plurality of tracks 42 comprising an electrically conductive susceptor material extend circumferentially around the paper wrapper 40 at axially spaced positions, with each track forming a closed circuit. The electrically conductive tracks 42 are inductively heated during use of the article 4 in the presence of a time varying electromagnetic field and the heat is transferred from the electrically conductive tracks 42 into the aerosol forming material of the first and second bodies 22, 26.

The electrically conductive tracks 42 can be mounted on the inner surface of the paper wrapper 40 and/or on the outer surface of the paper wrapper 40. For example, if a greater level of heat transfer to the aerosol forming material of the first body 22 is desired, it would be preferable to mount the electrically conductive tracks 42 on the inner surface of the paper wrapper 40. Conversely, if a greater level of heat transfer to the aerosol forming material of the second body 26 is desired, it would be preferable to mount the electrically conductive tracks 42 on the outer surface of the paper wrapper 40. In some embodiments, it is contemplated that the electrically conductive tracks 42 could be mounted on both the inner and outer surfaces of the paper wrapper 40, for example axially adjacent electrically conductive tracks 42 could be mounted in an alternating and repeating manner on the inner and outer surfaces respectively of the paper wrapper 40.

Figure 6:
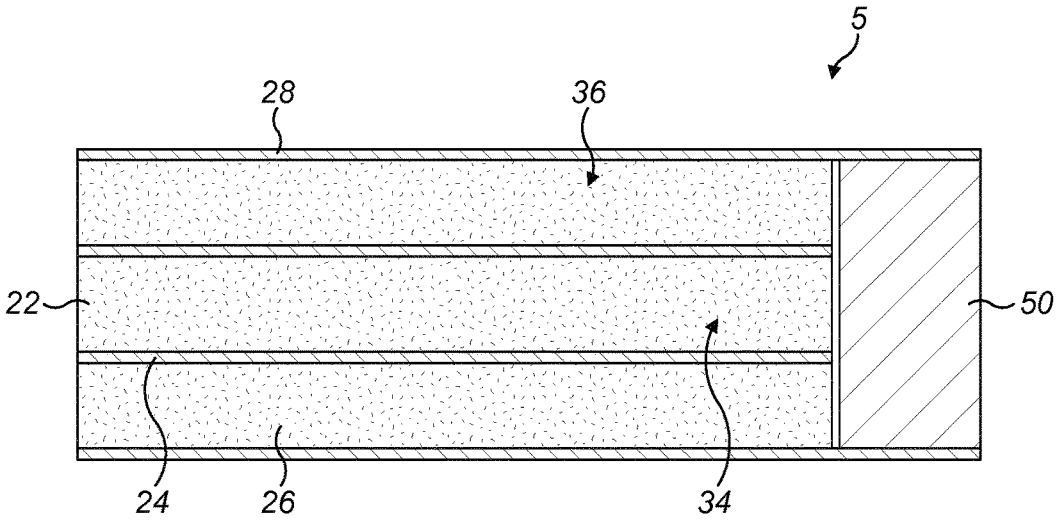
FIG. 6 is a diagrammatic cross-sectional side view of a fifth example of an aerosol generating article similar to the first example shown in FIGS. 1 and 2 and fitted with an air-permeable plug at an axial end thereof.

Referring now to FIG. 6, there is shown a diagrammatic cross-sectional side view of a fifth example of an aerosol generating article 5 which is similar to the aerosol generating article 1 illustrated in FIGS. 1 and 2 and in which corresponding elements are designated using the same reference numerals.

The aerosol generating article 5 includes an air-permeable plug 50, for example comprising cellulose acetate fibres, at an axial end thereof. The axial dimension of the paper wrapper constituting the second tubular member 28 is larger than the axial dimension of metal wrapper constituting the first tubular member 24 to define a cavity in which the air-permeable plug 50 is positioned.

Figure 7:
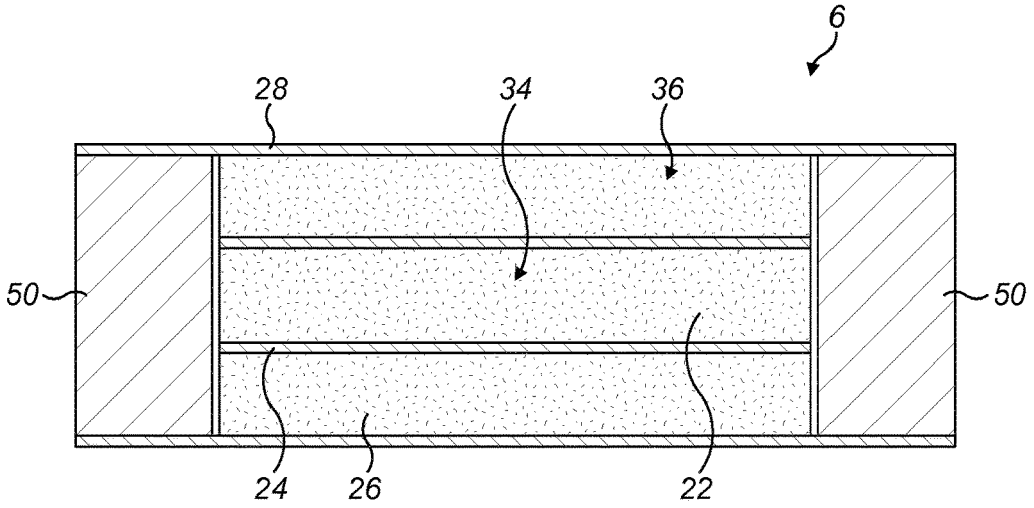
FIG. 7 is a diagrammatic cross-sectional side view of a sixth example of an aerosol generating article similar to the first example shown in FIGS. 1 and 2 and fitted with air-permeable plugs at both axial ends.

Referring now to FIG. 7, there is shown a diagrammatic cross-sectional side view of a sixth example of an aerosol generating article 6 which is similar to the aerosol generating articles 1 and 5 illustrated in FIGS. 1, 2 and 6 and in which corresponding elements are designated using the same reference numerals.

The aerosol generating article 6 includes two of said air-permeable plugs 50, one at each axial end of the article 6. The axial dimension of the paper wrapper constituting the second tubular member 28 is again larger than the axial dimension of metal wrapper constituting the first tubular member 24 so that it defines two cavities at axially opposite ends of the article 6 in which the air-permeable plugs 50 are positioned.

Figure 8:
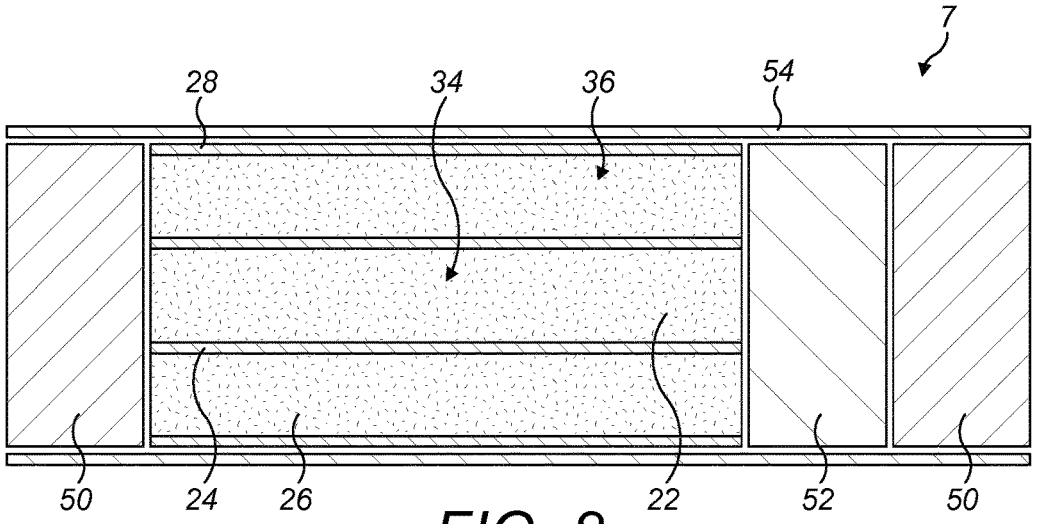
FIG. 8 is a diagrammatic cross-sectional side view of a seventh example of an aerosol generating article similar to the first example shown in FIGS. 1 and 2 and fitted with air-permeable plugs at both axial ends and having an outer wrapper.

Referring now to FIG. 8, there is shown a diagrammatic cross-sectional side view of a seventh example of an aerosol generating article 7 which is similar to the aerosol generating article 1 illustrated in FIGS. 1 and 2 and in which corresponding elements are designated using the same reference numerals.

The aerosol generating article 7 includes two of said air-permeable plugs 50, one at each axial end of the article 7. The article 7 also includes a body of air-permeable material 52, for example comprising a vapour cooling medium, positioned between one of the air-permeable plugs 50 and the first and second bodies of aerosol forming material 22, 26.

The first and second bodies of aerosol forming material 22, 26 and the first and second tubular members 24, 28 all have the same axial length and are arranged so that axial ends of the first and second bodies of aerosol forming material 22, 26 are axially aligned with the metal wrapper constituting the first tubular member 24 and with the paper wrapper constituting the second tubular member 28. The air-permeable plugs 50 and the air-permeable body 52 are in abutting coaxial alignment with the first and second bodies of aerosol forming material 22, 26 and the first and second tubular members 24, 28. Accordingly, the article 7 further comprises an outer wrapper 54, for example a paper wrapper, which circumscribes the article components to secure them in position.

Figure 9:
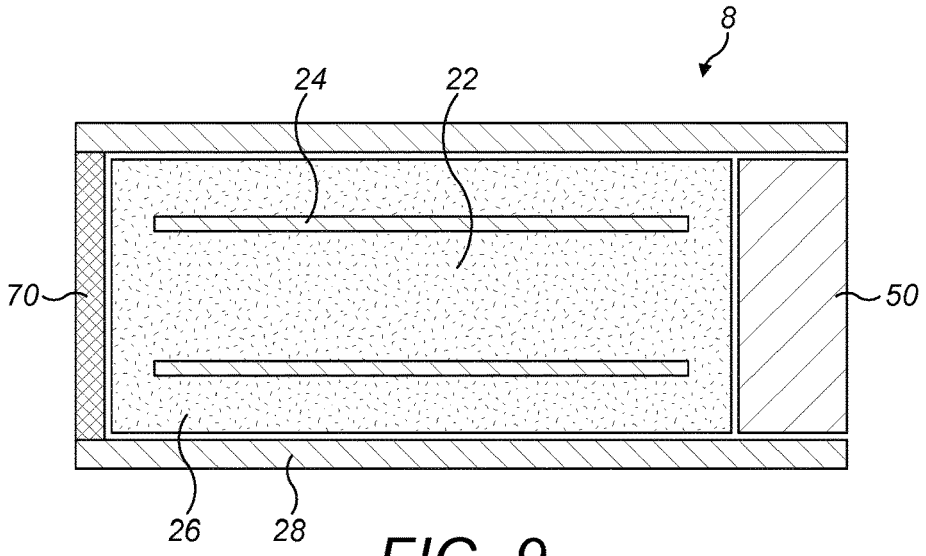
FIG. 9 is a diagrammatic cross-sectional side view of an eighth example of an aerosol generating article.

Referring now to FIG. 9, there is shown a diagrammatic cross-sectional side view of an eighth example of an aerosol generating article 8 in which corresponding elements are designated using the same reference numerals.

The first tubular member 24 comprises a pipe or tube having a relatively rigid structure when compared, for example, to the metal wrapper used in the examples described above.

The aerosol generating article 8 includes an air-permeable plug 50 at one axial end thereof which, as noted above, typically comprises cellulose acetate fibres. At the opposite axial end of the article 8, a mesh 70 or similar air-permeable structure is provided to retain the first and second bodies of aerosol forming material 22, 26 in position. The mesh 70 and the second tubular member 28 are typically formed integrally as a single component, for example as a moulded plastics component.

It will be noted in the aerosol generating article 8 that the axial dimension of the first tubular member 24 is less than the axial dimension of the second tubular member 28. With this arrangement, the first and second bodies of aerosol forming material 22, 26 comprise a single body of homogenous aerosol forming material, for example in the form of granules or pellets.

Figure 10:
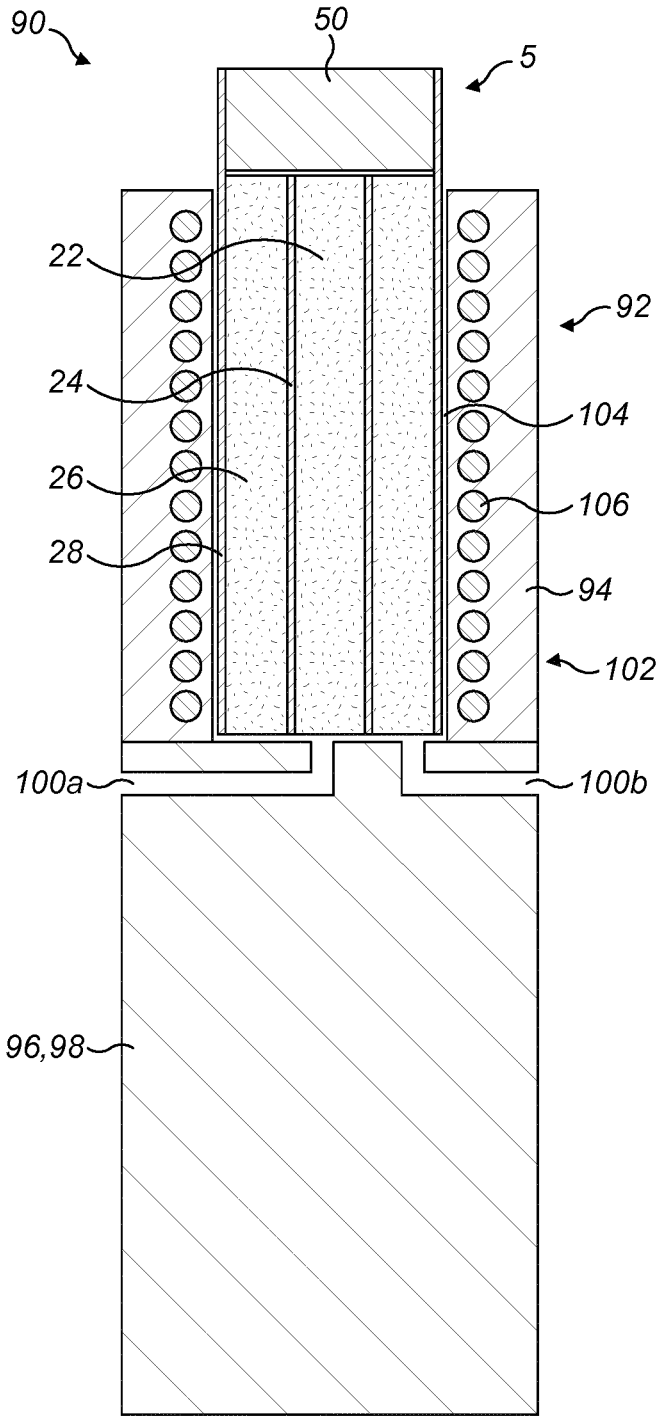
FIG. 10 is a diagrammatic cross-sectional view of an aerosol generating system comprising a first example of an aerosol generating device and the fifth example of the aerosol generating article illustrated in FIG. 6.

Referring now to FIG. 10, there is shown an aerosol generating system 90 for generating an aerosol to be inhaled. The aerosol generating system 90 comprises a first example of an aerosol generating device 92. The aerosol generating device 92 comprises a housing 94, a power source 96 and control circuitry 98 which may be configured to operate at high frequency. The power source 96 typically comprises one or more batteries which could, for example, be inductively rechargeable. The aerosol generating device 92 also includes first and second air inlets 100*a*, 100*b*.

The aerosol generating device 92 comprises an induction heating assembly 102 for heating an aerosol forming material. The induction heating assembly 102 comprises a generally cylindrical heating compartment 104 which is arranged to receive a correspondingly shaped generally cylindrical aerosol generating article in accordance with aspects of the present disclosure.

FIG. 9 shows the aerosol generating article 5 illustrated in FIG. 6 positioned in the heating compartment 104. The heating compartment 104 and the aerosol generating article 5 are arranged so that the air-permeable plug 50 projects from the heating compartment 104 thus enabling a user to engage their lips with the projecting part of the article 5 to inhale aerosol generated during operation of the system 100 through the air-permeable plug 50.

The air inlets 100*a*, 100*b* are both in communication with the heating compartment 104. It will be noted that the air inlet 100*a* is arranged to direct air through the first body of aerosol forming material 22 and that the air inlet 100*b* is arranged to direct air through the second body of aerosol forming material 26.

The induction heating assembly 102 comprises a helical induction coil 106, having first and second axial ends, which extends around the cylindrical heating compartment 104 and which can be energised by the power source 96 and control circuitry 98. Thus, the induction coil 106 defines a cavity, in the form of heating compartment 104, in which the aerosol generating article 5 is positioned. It will be noted that the heating compartment 104 and the aerosol generating article 5 each have a respective longitudinal axis and that the longitudinal axes are substantially aligned with each other when the aerosol generating article 5 is positioned inside the heating compartment 104.

The control circuitry 98 includes, amongst other electronic components, an inverter which is arranged to convert a direct current from the power source 96 into an alternating high-frequency current for the induction coil 106. As will be understood by those skilled in the art, when the induction coil 106 is energised by the alternating high-frequency current, an alternating and time-varying electromagnetic field is produced. This couples with the metal wrapper constituting the first tubular member 24 and generates eddy currents and/or magnetic hysteresis losses in the metal wrapper causing it to heat up. The heat is then transferred from the metal wrapper to the aerosol forming material of the first and second bodies 22, 26, for example by conduction, radiation and convection.

In the example of FIG. 10, the metal wrapper constituting the first tubular member 24 is in direct contact with the aerosol forming material of the first and second bodies 22, 26, such that when the metal wrapper is inductively heated by the induction coil 106 of the induction heating assembly 102, heat is transferred from the metal wrapper to the aerosol forming material, to heat the aerosol forming material and produce an aerosol. The aerosolisation of the aerosol forming material of the first and second bodies 22, 26 is facilitated by the addition of air from the surrounding environment through the air inlets 100*a*, 100*b*. The aerosol generated by heating the aerosol forming material of the first and second bodies 22, 26 then exits the inner and annular cavities 34, 36 of the article 1 through the air-permeable plug 50 and may, for example, be inhaled by a user of the system 90.

Figure 11:
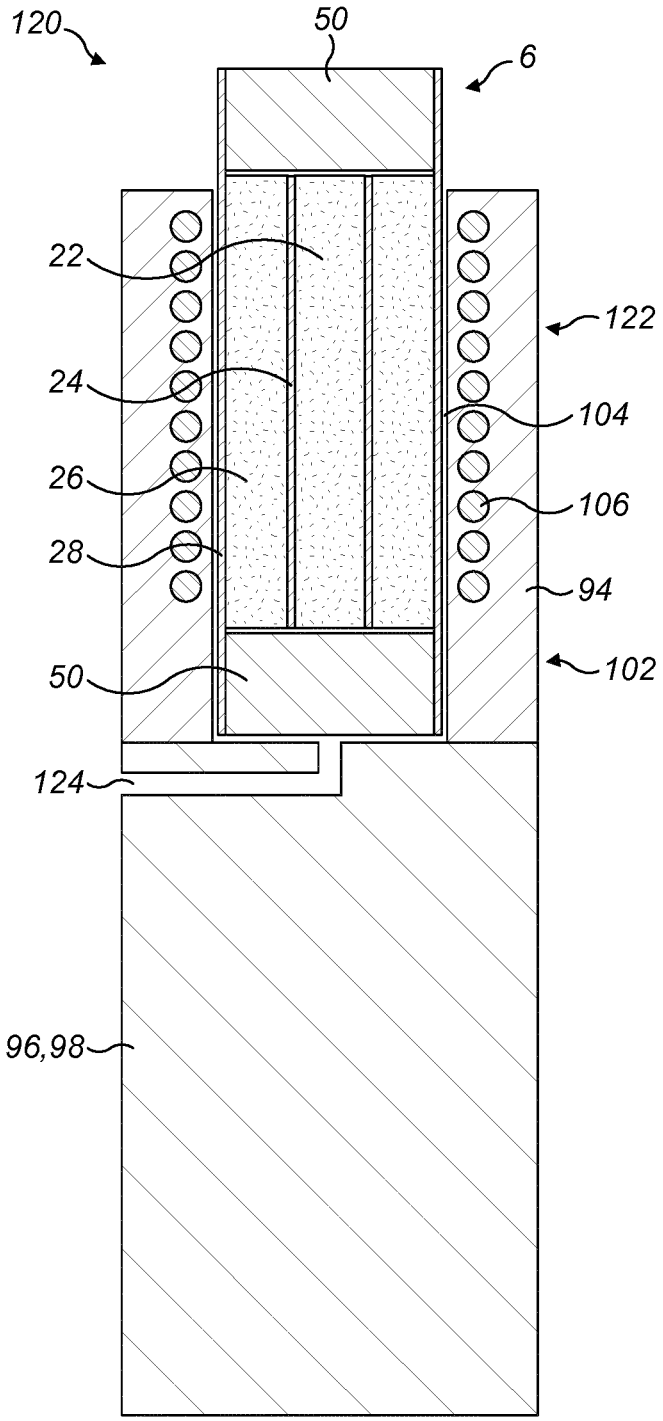
FIGS. 11 and 12 are diagrammatic cross-sectional views of an aerosol generating system comprising a second example of an aerosol generating device and the sixth and eighth examples of the aerosol generating articles illustrated in FIGS. 7 and 9 respectively.

Referring now to FIG. 11, there is shown an aerosol generating system 120 for generating an aerosol to be inhaled. The aerosol generating system comprises a second example of an aerosol generating device 122 which is similar to the aerosol generating device 92 shown in FIG. 10 and in which corresponding components are designated using the same reference numerals.

The aerosol generating device 122 is identical to the aerosol generating device 92 except that it comprises a single air inlet 124 in communication with the heating compartment 104. A single air inlet 124 is sufficient because the aerosol generating device 122 is suitable for use with the aerosol generating article 6 of FIG. 7 which is shown positioned inside the heating compartment 104. As previously explained, the aerosol generating article 6 includes air-permeable plugs 50 at both axial ends and the air-permeable plug 50 at the lower axial end viewed in FIG. 11 directs air received through the air inlet 124 through both the first body of aerosol forming material 22 in the inner cavity 34 and through the second body of aerosol forming material 26 in the annular cavity 36.

Figure 12:
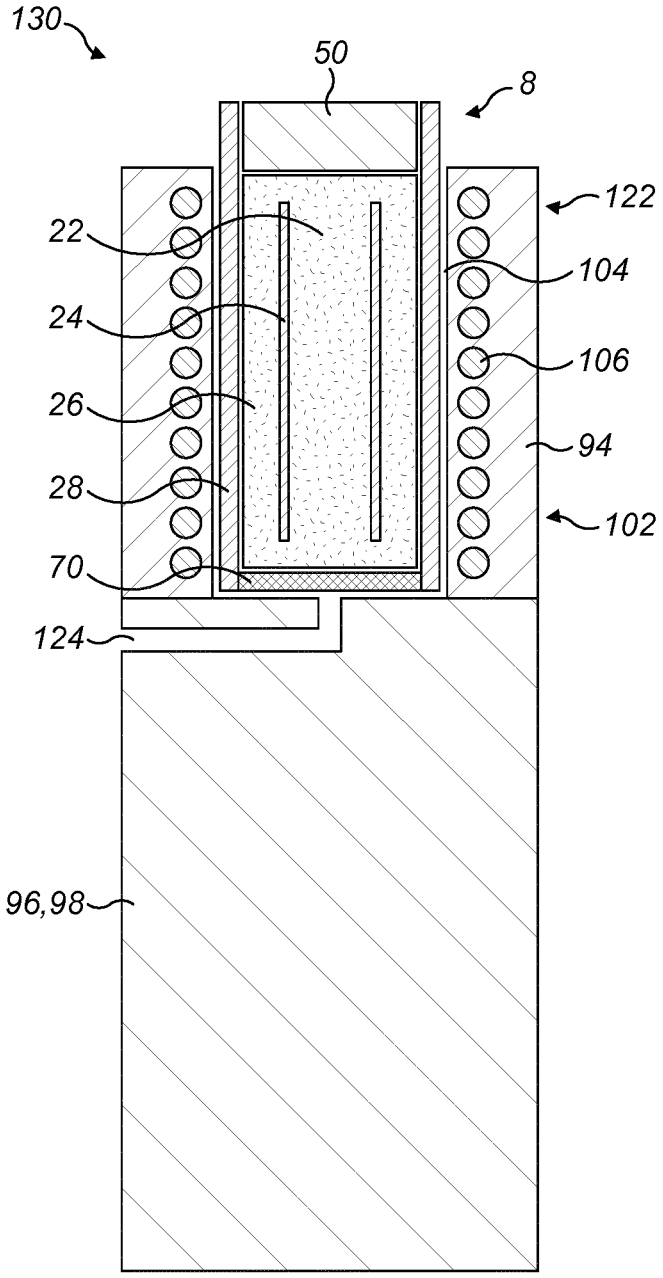

Referring now to FIG. 12, there is shown an aerosol generating system 130 for generating an aerosol to be inhaled. The aerosol generating system comprises the same aerosol generating device 122 that has already been described above with reference to FIG. 11 and the aerosol generating article 8 of FIG. 9 positioned inside the heating compartment 104. The aerosol generating article 8 is particularly suitable for use with the aerosol generating device 122 with its single air inlet 124 into the heating compartment 104 because the mesh 70 permits air to flow throughout the entirety of the single body of homogenous aerosol forming material that is formed by the first and second bodies 22, 26.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments.

Any combination of the above-described features in all possible variations thereof is encompassed by the present disclosure unless otherwise indicated herein or otherwise clearly contradicted by context.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. An aerosol generating article comprising:

a first body of aerosol forming material;

a first tubular member surrounding the first body of aerosol forming material;

a second body of aerosol forming material surrounding the first tubular member, substantially the entire first tubular member disposed between the first body of aerosol forming material and the second body of aerosol forming material;

a second tubular member surrounding the second body of aerosol forming material;

wherein the first tubular member is inductively heatable in the presence of a time varying electromagnetic field.

2. The aerosol generating article according to claim 1, wherein the first tubular member includes a closed electrical circuit formed by an inductively heatable susceptor material.

3. The aerosol generating article according to claim 1, wherein the first tubular member comprises a wrapper formed of an inductively heatable susceptor material.

4. The aerosol generating article according to claim 3, wherein the article includes holding means for holding together free edges of the wrapper.

5. The aerosol generating article according to claim 1, wherein the first tubular member further includes a wrapper comprising a material which is substantially non-electrically conductive and non-magnetically permeable.

6. The aerosol generating article according to claim 1, wherein the first tubular member) defines an inner cavity in which the first body of aerosol forming material is positioned and the first and second tubular members define therebetween an annular cavity which is separate from the inner cavity and in which the second body of aerosol forming material is positioned.

7. The aerosol generating article according to claim 1, wherein the article is elongate and the axial ends of the first body of aerosol forming material, the second body of aerosol forming material and the first tubular member are axially aligned.

8. The aerosol generating article according to claim 1, wherein the first and second bodies of aerosol forming material each have respective first and second cross-sectional areas and the first and second cross-sectional areas are substantially the same.

9. The aerosol generating article according to claim 1, wherein the first and second bodies of aerosol forming material each have respective first and second volumes and the first and second volumes are substantially the same.

10. The aerosol generating article according to claim 1, further comprising an air-permeable plug at an axial end thereof to retain the first body of aerosol forming material inside the first tubular member and the second body of aerosol forming material between the first and second tubular members.

11. The aerosol generating article according to claim 1, wherein the first and second bodies of aerosol forming material comprise a single body of homogenous aerosol forming material.

12. The aerosol generating article according to claim 1, wherein the first and second bodies of aerosol forming material have characteristics which differ in at least one or more respects, including aerosolisation temperature, humectant content, flavour and density.

13. A method for manufacturing an aerosol generating article, the method comprising:

positioning a first tubular member around a first body of aerosol forming material, the first tubular member being inductively heatable in the presence of a time varying electromagnetic field;

after the step of positioning the first tubular member, positioning a second body of aerosol forming material around the first tubular member; and positioning a second tubular member around the second body of aerosol forming material.

14. The method according to claim 13, wherein the first tubular member comprises a sheet of material and the step of positioning the first tubular member around the first body of aerosol forming material comprises wrapping the sheet of material around the first body of aerosol forming material.

15. An aerosol generating system comprising:

an aerosol generating device comprising an induction coil defining a cavity, the induction coil being configured to generate a time varying electromagnetic field; and the aerosol generating article according to claim 1 positioned in the cavity so that a longitudinal axis of the first tubular member is substantially aligned with a longitudinal axis of the cavity.

* * * * *